United States Patent [19]

Sickler

[11] 4,402,413

[45] Sep. 6, 1983

[54] COUNTERWEIGHT ARRANGEMENT

[75] Inventor: Emory J. Sickler, Wausau, Wis.

[73] Assignee: J. I. Case Company, Racine, Wis.

[21] Appl. No.: 322,897

[22] Filed: Nov. 19, 1981

[51] Int. Cl.[3] ..... B66C 23/72

[52] U.S. Cl. ..... 212/178; 212/197; 414/719

[58] Field of Search ..... 212/156, 178, 191, 195–198; 414/69, 673, 719

[56] References Cited

U.S. PATENT DOCUMENTS

| | | | |
|---|---|---|---|
| 2,674,378 | 4/1954 | Meyer et al. | 212/178 |
| 3,266,636 | 8/1966 | Dorn | 212/196 |
| 3,653,486 | 4/1972 | McLean et al. | 212/196 |
| 3,726,416 | 4/1973 | Pottorff et al. | 212/178 |
| 3,891,095 | 6/1975 | Symmank | 212/178 |
| 3,963,133 | 6/1976 | Gilli | 414/719 |

FOREIGN PATENT DOCUMENTS

| | | | |
|---|---|---|---|
| 1139959 | 11/1962 | Fed. Rep. of Germany | 212/196 |

*Primary Examiner*—Trygve M. Blix
*Assistant Examiner*—Stephen P. Avila
*Attorney, Agent, or Firm*—Dressler, Goldsmith, Shore, Sutker & Milnamow, Ltd.

[57] ABSTRACT

A counterweight arrangement for mobile vehicles including a pair of transversely spaced support members having notches formed therein. The counterweight has a pair of transversely spaced rod members secured thereto which are selectively received in the notches. A pair of transversely spaced cables are secured to the counterweight to raise and lower the counterweight. The cables are received around corresponding sheaves which may be repositioned to control the movement of the rod members into and out of the notches and around the support members.

7 Claims, 10 Drawing Figures

COUNTERWEIGHT ARRANGEMENT

BACKGROUND OF THE INVENTION

This invention relates to mobile vehicles such as excavators, cranes and the like, and, more particularly to an improved counterweight arrangement for such vehicles.

The booms and power hoist equipment of excavators, cranes, and the like are often mounted on a carrier vehicle, such as a crawler type carrier or a pneumatic tired truck chassis, to afford an easily transportable unit. The boom is generally supported at its foot upon one end of a machinery platform which also mounts the power hoist equipment, and such platform is in turn supported on a turntable so that the boom may be rotated for reach in any direction relative to the supporting chassis. It is necessary to counterbalance the boom and load carried thereby and this is accomplished in part by placing the power hoist equipment at an opposite end of the machinery platform remote from the boom with the turntable supporting the platform at some intermediate point. This, however, will provide only a partial counterbalancing of a boom with a large reach and it is necessary to provide a massive counterweight which generally is supported at the opposite end of the machinery platform.

It is the common practice to mount the counterweight in a manner which permits the removal of the counterweight to enhance the moveability of such vehicles. It is most desirable that the counterweight be capable of removal with a minimum of time and effort so that the down time of the units occasioned by the removal is small. However, when the excavator, crane, or the like, is in operation the counterweight must be positively supported upon the platform and secured against swinging or swaying. Further, the mobile vehicle may be the only hoisting equipment available at a particular site so that separate hoisting equipment should not be necessary to remove the counterweight from the platform.

It has heretofore been proposed to mount a counterweight to the rear end of a crane or excavator and to utilize the boom hoist mechanism to raise and lower the counterweight. Examples of such devices are disclosed in U.S. Pat. Nos. 2,689,655, 3,251,479 and 3,278,045. It has also been heretofore proposed to utilize a cable extending between the boom of a crane or the bucket of a tractor and the counterweight to raise and lower the counterweight. Examples of such devices are disclosed in U.S. Pat. Nos. 3,135,404 and 3,726,416.

The present invention is directed to an improved counterweight arrangement which is simpler in construction, less costly to manufacture and more reliable in operation than the heretofore utilized arrangements to raise and lower counterweights.

SUMMARY OF THE INVENTION

The counterweight arrangement of the present invention meets the foregoing requirements by providing a pair of transversely spaced support members, having notches therein, which extend rearwardly of the vehicle frame. The counterweight has a pair of transversely spaced rod members secured thereto which are selectively craddled in the notches. A pair of transversely spaced cables are secured to the counterweight and are controlled by selective pivotal movement of the vehicle boom. Each cable is received around a corresponding sheave which is supported above a corresponding support member. In order to control the movement of the rod members into and out of the notches and around the support members, each sheave is mounted to a longitudinally extending bracket having a pair of longitudinally spaced openings to selectively receive the sheave. The support members are provided with camming surfaces to contact the rod members and direct them rearwardly around the support members as the counterweight is raised. The counterweight is provided with suitable cut-out portions to receive the rod members and to permit the raising and lowering thereof without interference with various vehicle structure. The brackets which receive the sheaves are preferable pivotal about a substantially vertical axis to permit storage thereof when not in use.

DESCRIPTION OF A PREFERRED EMBODIMENT

Figure 1:
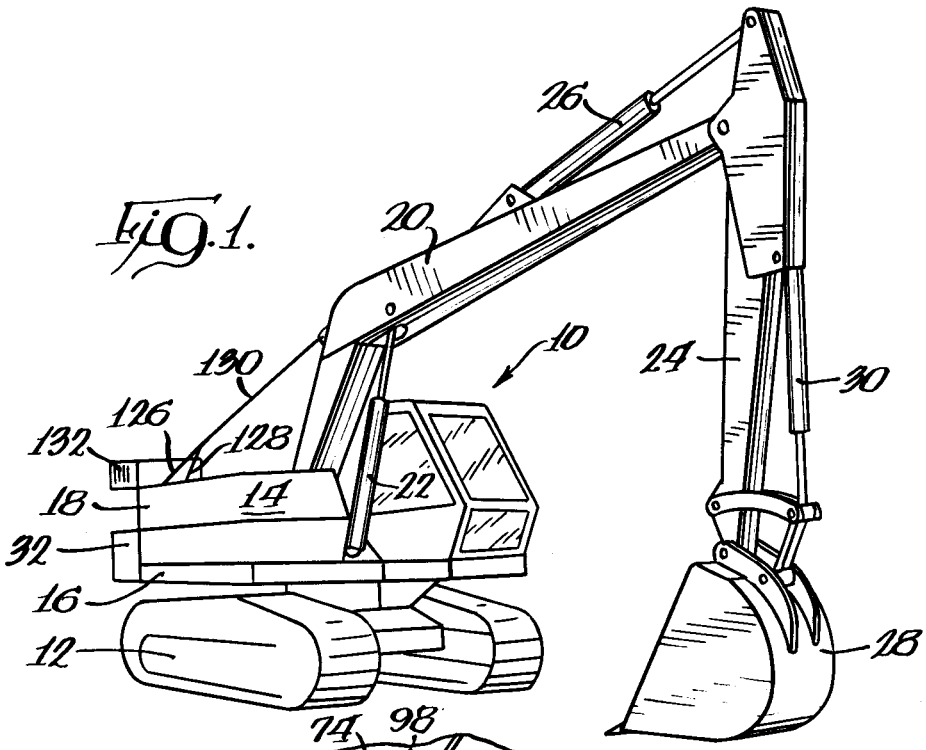
FIG. 1 is a perspective view of a vehicle embodying the invention with the counterweight in its raised or stored position.

Referring to the drawings, and particularly to FIG. 1, there is shown a hydraulic back-hoe type of excavator 10 which is more or less conventional in overall construction and includes a crawler type carrier vehicle designated by the reference numeral 12. Excavator 10 also includes a working frame 14 which is rotatably mounted on the carrier vehicle 12 and which includes a machinery platform 16 and a machinery housing 18 that encloses the operating machinery. Excavator 10 also has a boom 20 pivotally mounted on the machinery platform 16, hydraulic hoist cylinder 22, a dipper stick 24, a hydraulic dig cylinder 26, a bucket 28 and a hydraulic wrist cylinder 30. It will be apparent as this description progresses, that other specific forms of machines might be provided with a counterweight arrangement according to the present invention, so long as they include some boom or equivalent means to raise and lower the counterweight. For this reason, and since the construction and operation of the excavator 10 are well understood by those skilled in the art, the various elements thereof are not shown and will not be described in greater detail.

Figure 2:
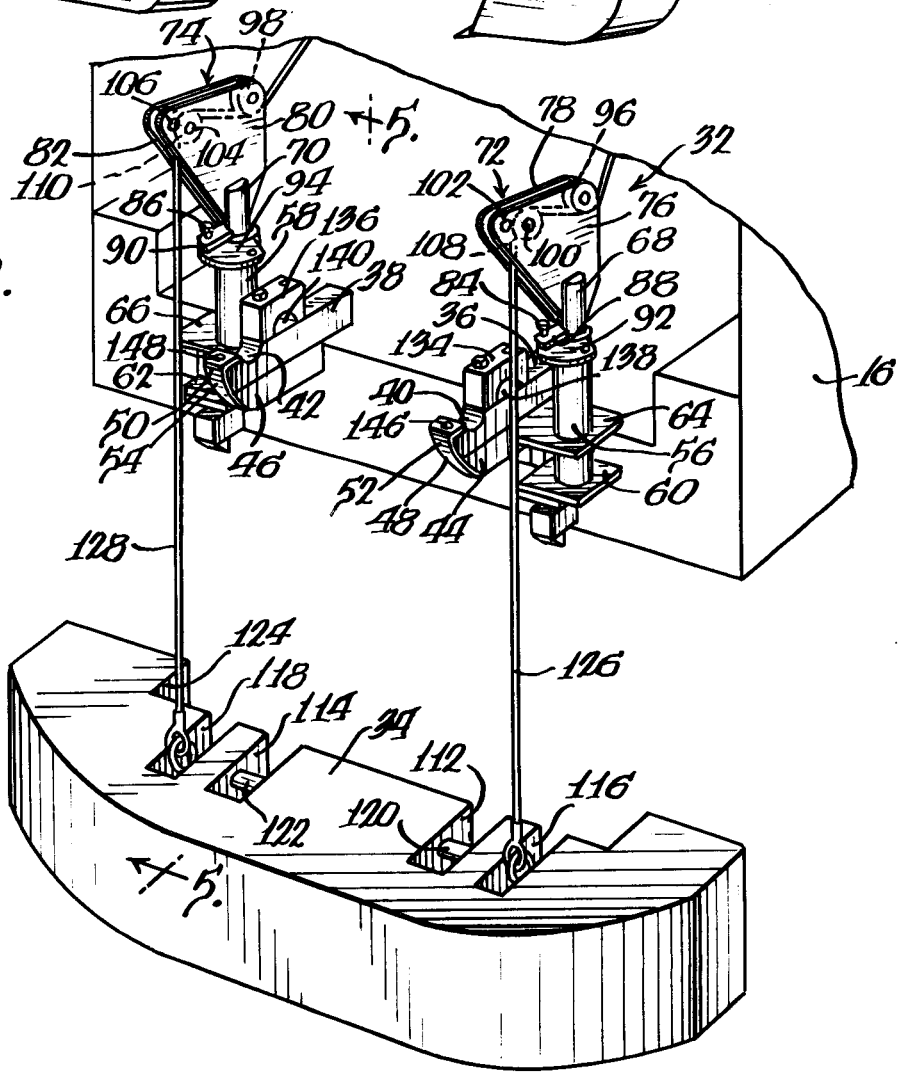
FIG. 2 is an enlarged perspective view of a portion of the rear end of the vehicle as shown in FIG. 1 showing the invention with the counterweight in its lowered position on the ground.
Figure 3:
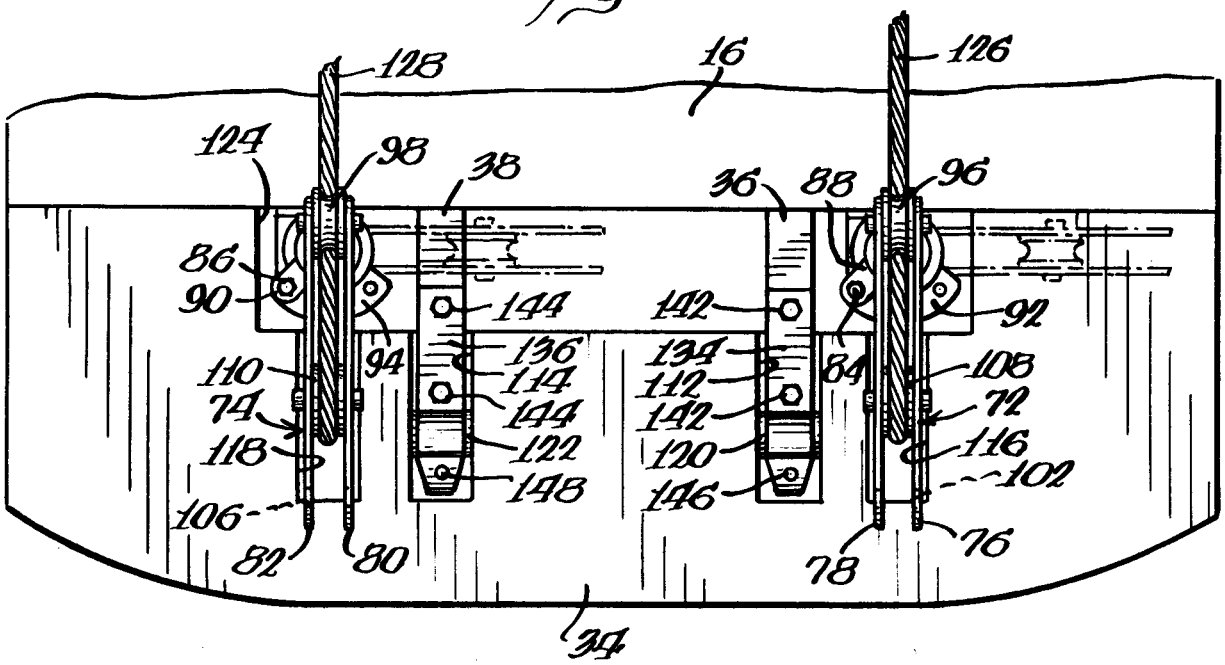
FIG. 3 is a top plan view of the counterweight arrangement in accordance with the invention with the counterweight in its raised or stored position and showing the sheaved support brackets in solid lines in their operative position and in phantom lines in their stored position.

As best seen in FIGS. 1 and 2, the excavator 10 is provided with a counterweight assembly, indicated generally at 32, which is secured to the rear end of the machinery platform 16 so as to counterbalance loads handled by the bucket 28 and thereby increase the load handling capacity of the excavator. Counterweight assembly 32 includes a removable counterweight member 34 which is cast to have a generally smooth arcuate exterior surface and an interior surface which is cut away in a manner which will become hereinbelow more apparent. Counterweight member 34 is supported on a pair of support or saddle members 36 and 38, which are suitably welded to longitudinally structural I-beams (not shown) associated with the rear end of machinery platform 16, and extend rearwardly therefrom as best seen in FIGS. 2 and 3. Support members 36 and 38 have transversely aligned notches or recesses 40 and 42 formed in the respective upper surfaces thereof.

As best seen in FIG. 2, the rear ends of members 36 and 38 are curved downwardly and inwardly. Plate members 44 and 46 are respectively welded to the undersurface of members 36 and 38; the rear edges of which generally continue the curvature of the respective rear ends of members 36 and 38. Curved facing plates 48 and 50 are respectively welded to the rear edges of members 36 and 44 and members 38 and 46. Plates 48 and 50 are preferably of a width equal to the width of members 36 and 38 at their upper ends and of a width substantially equal to the width of plate members 44 and 46 at their lower ends. Plates 48 and 50 serve to form respective camming surfaces 52 and 54.

A pair of vertical sleeve members 56 and 58 are secured to the rear end of machinery platform 16 adjacent to the outside surfaces of respective members 36 and 38. Sleeves 56 and 58 are respectively secured to plates 60 and 64 and plates 62 and 66. Plates 60 and 62 are welded to the rear end of platform 16 and plates 64 and 66 are respectively welded to members 36 and 38. The lower ends of sleeves 56 and 58 rest on, and are respectively welded to, the upper surfaces of plates 60 and 62. Sleeves 56 and 58 respectively pass through openings in plates 64 and 66 and intermediate sections thereof are welded thereto.

Referring to FIG. 2, a pair of sheave supporting bracket assemblies 72 and 74 are welded to the upper ends of respective posts 68 and 70 and extend upwardly therefrom. Bracket assemblies 72 and 74 include pairs of spaced, parallel bracket plates as indicated respectively at 76 and 78 and at 80 and 82. Bracket assemblies 72 and 74 have a first or operative position wherein the bracket plates are perpendicular to the rear end of the machinery platform, as seen in FIG. 2, and a second or stored positioned wherein the bracket plates are parallel to the rear end of the machinery platform, as seen in phantom lines in FIG. 3. Assemblies 72 and 74 are selectively locked in their first and second positions by pins 84 and 86 which pass respectively through openings in flanges 88 and 90, welded respectively to posts 68 and 70, and corresponding openings in flanges 92 and 94, welded respectively to sleeves 56 and 58. Flanges 92 and 94 have two sets of openings to correspond to the two positions.

When viewed with the bracket assemblies 72 and 74 in their operative positions, as best seen in FIGS. 2 and 5–10, inner sheaves 96 and 98 are respectively journalled for rotation between plates 76 and 78 and plates 80 and 82 adjacent to the upper inner ends thereof. Pairs of longitudinally spaced pairs of openings 100 and 102 and openings 104 and 106 are respectively provided through the upper outer ends of plates 76 and 78 and plates 80 and 82. Outer sheaves 108 and 110 are selectively journalled for rotation through the respective pairs of openings 100 or 102 and 104 or 106.

Counterweight member 34 is formed with appropriate cut-out portions to permit clearance of various structural members associated with the rear end of the machinery platform 16. Cut-outs 112 and 114 are formed in member 34 in longitudinal alignment with support members 36 and 38. Cut-outs 116 and 118 are formed in member 34 in longitudinal alignment with posts 68 and 70. Transverse rods 120 and 122 are respectively secured in place within cut-outs 112 and 114. Cut-out 124 is formed in member 34 in longitudinal alignment with the outer extremities of plates 60 and 62 to permit their passage therethrough.

Figure 4:
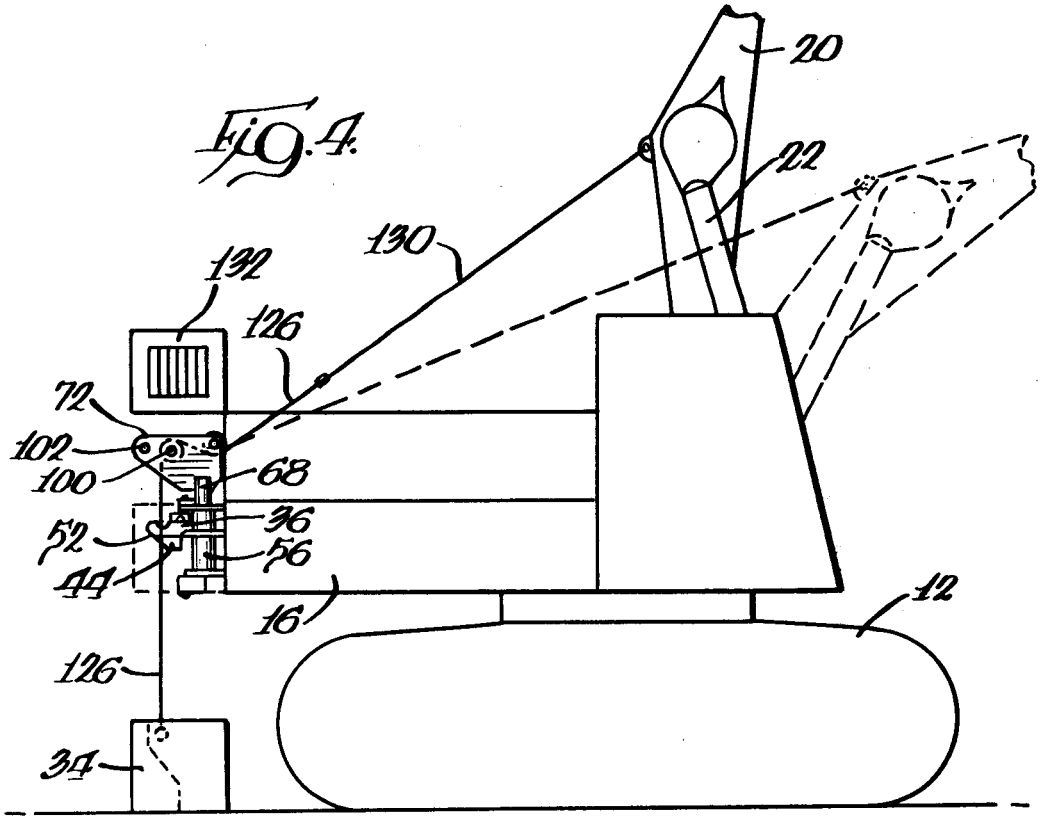
FIG. 4 is a schematic side view of a portion of the vehicle shown in FIG. 1 showing the positioning of the boom and the counterweight in solid lines with the counterweight in its lowered position on the ground and the positioning of the boom and the counterweight in phantom lines with the counterweight in its raised or stored position.

Referring to FIGS. 1, 2 and 4, a pair of cables 126 and 128 are suitably secured at one of their respective ends to counterweight member 34 at cut-outs 116 and 118. Cables 126 and 128 are preferably releasably secured to member 34 so as to permit their removal when not in use. Cables 126 and 128 extend upward over respective sheaves 108 and 110 and then under respective sheaves 96 and 98. The other ends of cables 126 and 128 are joined together and connected to a cable 130 which is releasably secured to boom 20, as best seen in FIG. 1. Pivotal movement of boom 20 is effective to raise and lower counterweight member 34 through cables 126, 128 and 130.

A description of the operation of the counterweight assembly 32, in accordance with the invention, which hereinbelow follows, further discloses various space relationships, the significance of which will become readily apparent.

Figure 5:
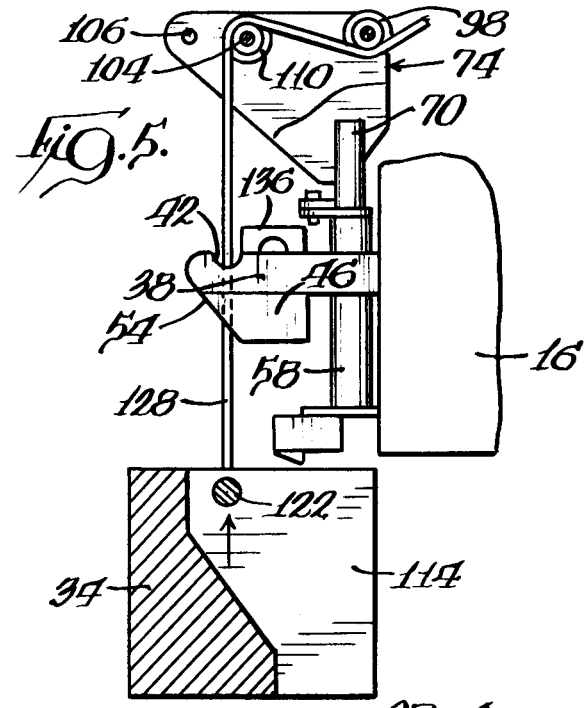
FIG. 5 is sectional view taken along line 5—5 in FIG. 2 showing the invention with the counterweight in its lowered position on the ground and the sheave in its first or inner position.

Referring to FIG. 5, the counterweight 34 is shown in its lowered position resting on the ground. Brackets 72 and 74 are in their operative positions. Sheaves 108 and 110 are positioned in their first positions respectively through inner openings 100 and 104. Boom 20 is in its raised position as shown in solid lines in FIG. 4. At such time as it is necessary to mount counterweight 34 on supports 36 and 38, the boom 20 is slowly lowered towards the position shown in phantom lines in FIG. 4. The initial lowering of boom 20 is effective to raise counterweight 34 off the ground through cables 126, 128 and 130. Counterweight 34 assumes a position wherein cables 126 and 128, notches 40 and 42, and rods 120 and 122 are in a common transverse plane, as seen in FIG. 5. This is attained by the respective space relationships between sheaves 108 and 110 relative to rods 120 and 122.

Figure 6:
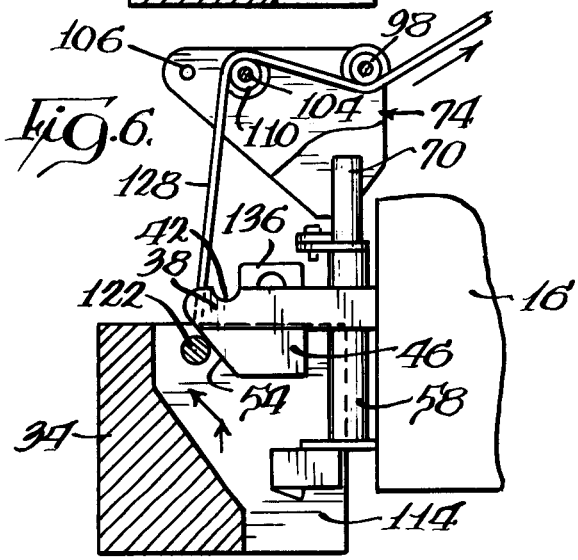
FIG. 6 is a sectional view as in FIG. 5 showing the invention with the counterweight raised off the ground and the rod in contact with the camming surface.
Figure 7:
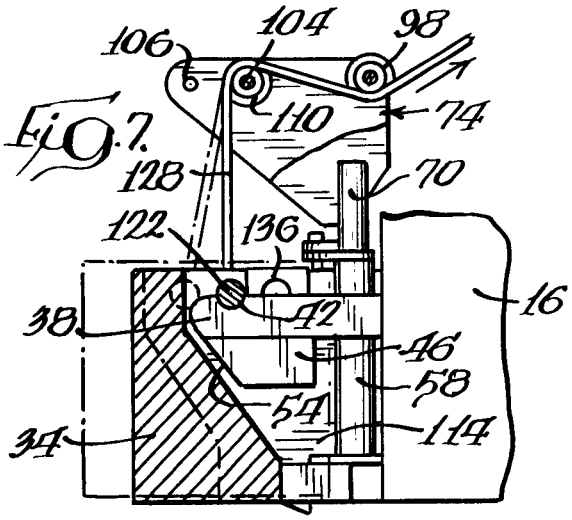
FIG. 7 is a sectional view as in FIG. 6 showing the invention with the counterweight in phantom lines immediately prior to attaining its raised or stored position and in solid lines in its raised or stored position.

As counterweight 34 is further raised off the ground by the lowering of boom 20, rods 120 and 122 contact respective surfaces 52 and 54 which cause the counterweight to move rearwardly as it is raised, as indicated by the arrows in FIG. 6. Rods 120 and 122 are guided by respective surfaces 52 and 54 up and around the rear ends of supports 36 and 38, as shown by phantom lines in FIG. 7. As rods 120 and 122 clear the upper edges of supports 36 and 38, counterweight 34 assumes its stored position wherein rods 120 and 122 are respectively positioned in notches 40 and 42, as shown in solid lines in FIG. 7. As will be hereinbelow described means are preferably provided to selectively retain counterweight 34 in its stored position. Cables 126, 128 and 130 are then removed and stored in an appropriate place for later use. Excavator 10 is now ready to perform its intended working operations.

Figure 8:
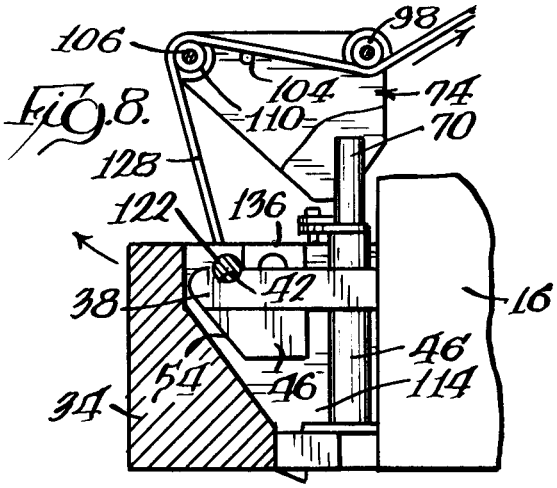
FIG. 8 is a sectional view as in FIG. 7 showing the invention with the counterweight in its raised or stored position and the sheave in its second or outer position.
Figure 9:
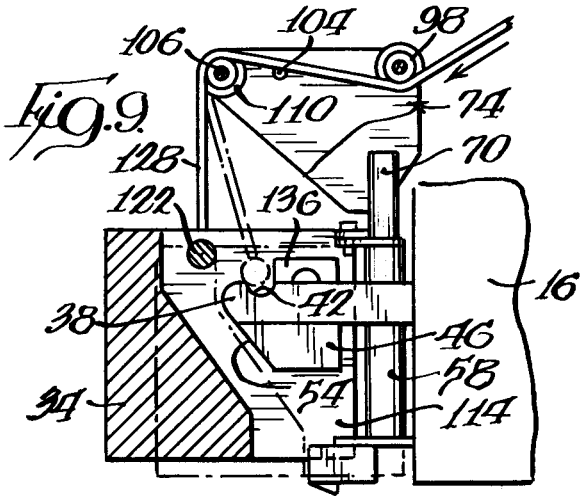
FIG. 9 is a sectional view as in FIG. 8 showing the invention with the counterweight in phantom lines as it is raised upwardly and outwardly from its raised or stored position and in solid lines in its outermost position.
Figure 10:
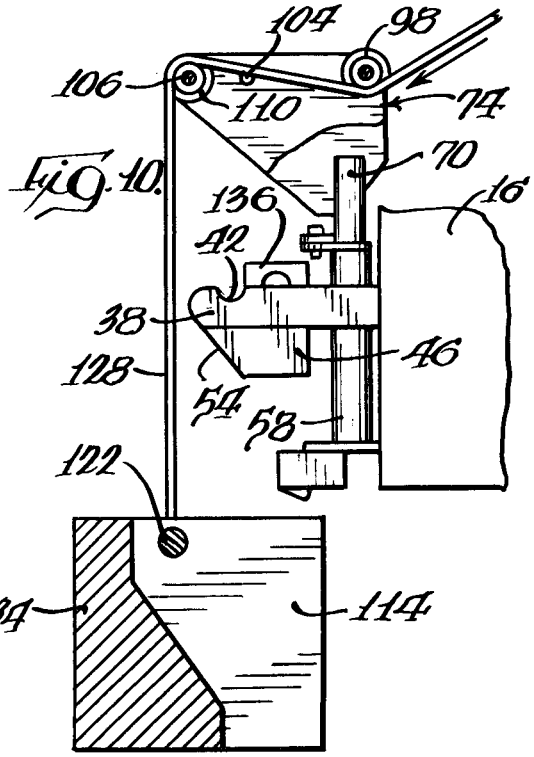
FIG. 10 is a sectional view as in FIG. 9 showing the invention with the counterweight in its lowered position on the ground.

At such time as it is necessary to remove counterweight 34, the sheaves 108 and 110 are respectively positioned in their second positions in openings 102 and 106 and cables 126, 128 and 130 are appropriately reattached to counterweight 34 and boom 20. Counterweight assembly 32 is now in the position as shown in FIG. 8. In order to remove rods 120 and 122 from notches 40 and 42, boom 20 is lowered such that cables 126 and 128 raise counterweight 34 a short distance so as to lift rods 120 and 122 above the top surfaces of supports 36 and 38, as shown in phantom lines in FIG. 9. As rods 120 and 122 clear the top surfaces of supports 36 and 38, counterweight 34 is caused to move outward, as shown in solid lines in FIG. 9. Sheaves 108 and 110 are now positioned such that the transverse plane passing through cables 126 and 128 and rods 120 and 122 is outside of the rear edges of supports 36 and 38. Counterweight 34 may then be lowered to the ground by raising boom 20, as shown in FIG. 10. Cables 126, 128 and 130 are again removed and appropriately stored. It should be appreciated that counterweight 34 is now resting on the ground and excavator 10 is ready to be relocated without the necessity of transporting counterweight 34 therewith.

A cover arrangement 132 is preferably pivotally mounted to platform 16 above counterweight assembly 32. Cover 132 has a first position above assembly 32, as shown in FIG. 4, and a second position, not shown, in covering relationship to assembly 32. Brackets 72 and 74 are moved to their stored position parallel to the rear end of platform 16, as shown in phantom lines in FIG. 3, to permit clearance of cover 132 as it is moved from its first position to its second position.

Referring to FIGS. 2 and 3, a pair of hold-down members 134 and 136 are provided to selectively retain rods 120 and 122 firmly in place in notches 40 and 42. Members 134 and 136 have notches 138 and 140 respectively formed in the bottom surfaces thereof for receipt of the upper portions of respective rods 120 and 122. Members 134 and 136 have pairs of longitudinally spaced bolt holes 142 and 144 formed respectively therethrough. The upper surfaces of supports 36 and 38 have corresponding threaded bolt holes, not shown, formed therein in vertical alignment with holes 142 and 144. Suitable fasteners pass through openings 142 and 144 to releasably secure members 134 and 136 respectively to supports 36 and 38. As seen in FIG. 2, the rear edges of members 134 and 136 are preferably in alignment with the forward edges of notches 40 and 42. Accordingly, the rear vertical surfaces of members 134 and 136 serve as stop members to contact and guide rods 120 and 122 into notches 40 and 42. Bolt holes 146 and 148 are respectively formed through the upper surfaces of supports 36 and 38 outward of respective notches 40 and 42. Accordingly, members 134 and 136 may be selectively secured to respective supports 36 and 38 with notches 40 and 42 in vertical alignment with corresponding notches 138 and 140. When so positioned, with rods 120 and 122 respectively positioned in the corresponding notches, members 134 and 136 serve to selectively retain counterweight 34 firmly in its operative position.

It can be seen that the counterweight assembly of the present invention is adapted to be removed from or secured to an excavating or load handling machine in an inexpensive, reliable, and efficient manner.

While the invention has been illustrated and described in a preferred form for use with a back-hoe type of excavator, it will be readily appreciated that the invention is equally useful with other load handling machines, which require a removable counterweight, and which have the capability of raising and lowering the cables. Furthermore, although a preferred form of the invention has been shown and described, variations are possible without departure from the spirit of the invention. It is to be understood that such variations may be made therefrom, without departing from the spirit of the invention or the scope of the appended claims.

What is claimed is:

1. In a mobile vehicle having a working frame and a pivotal boom means at the front end of the frame, an improved means for raising and lowering a counterweight removably mounted to the rear end of the frame, comprising:

counterweight support means extending rearward of the rear of said frame, said counterweight support means includes a pair of transversely spaced support members extending rearwardly of said frame and has transverse notches formed therein, said support members have camming surfaces associated with the outer ends thereof;

a counterweight having a pair of transversely spaced rod members secured thereto which are selectively received into said notches;

connecting means extending between said boom means and said counterweight for selectively raising and lowering said counterweight in response to pivotal movement of said boom means, said connecting means includes a pair of transversely spaced cable means which have first ends secured to said counterweight and second ends which are controlled by pivotal movement of said boom means; and means for selectively controlling the movement of said counterweight into and out of support on said support members, said means includes a pair of sheaves which are respectively supported above said support members and said cable means are received about said sheaves, said sheaves are selectively movable between first and second longitudinal positions such that as said counterweight is raised and lowered with said sheaves in said first positions said rod members are substantially in vertical alignment with said notches and as said counterweight is raised and lowered with said sheaves in said second positions said rod members are positioned rearwardly of the rearward ends of said support means, said camming surfaces cooperate with said rod members to direct said rod members rearwardly around the outer ends of said support members into said notches.

2. The invention as defined in claim 1 wherein each of said sheaves is mounted to a bracket means which extends longitudinally outward from the rear end of the frame, said bracket means having first and second longitudinally spaced openings for selective receipt of said sheaves in their first and second positions.

3. The invention as defined in claim 2 wherein said bracket means are pivotal about a substantially vertical axis.

4. The invention as defined in claim 3 wherein said bracket means are secured to a substantially vertical post which is received within a substantially vertical sleeve secured to the rear end of the frame.

5. The invention as defined in claim 4 wherein said counterweight has a pair of cut-out portions for receipt of said rod members therein and one of said cut-out portions is in longitudinal alignment with each of said support means.

6. The invention as defined in claim 5 wherein said counterweight has additional cut-out portions to permit receipt of said vertical sleeves therethrough as said counterweight is being raised.

7. The invention as defined in claim 1 wherein hold down means are releasably secured to said support means having first positions above said notches and second positions immediately inward of said notches so to guide said rod members into said notches.

* * * * *